US012194332B1

(12) United States Patent
Shi

(10) Patent No.: US 12,194,332 B1
(45) Date of Patent: Jan. 14, 2025

(54) WEIGHTLIFTING WATER BAG

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/763,039

(22) Filed: Jul. 3, 2024

(30) Foreign Application Priority Data

Mar. 30, 2024 (CN) ..... 202420650641.0

(51) Int. Cl.
*A63B 21/06* (2006.01)
*A63B 21/00* (2006.01)

(52) U.S. Cl.
CPC ..... *A63B 21/0602* (2013.01); *A63B 21/4035* (2015.10); *A63B 2225/09* (2013.01); *A63B 2225/62* (2013.01)

(58) Field of Classification Search
CPC ..... A63B 21/0602; A63B 21/4035; A63B 2225/09; A63B 2225/62
See application file for complete search history.

(56) References Cited

U.S. PATENT DOCUMENTS

| | | | | |
|---|---|---|---|---|
| 4,103,889 | A * | 8/1978 | Lobur | A63B 69/305 273/DIG. 20 |
| 9,199,151 | B2 * | 12/2015 | Fu | A63B 69/305 |
| 9,586,119 | B2 * | 3/2017 | Fu | A63B 69/34 |
| 10,350,474 | B1 * | 7/2019 | Magrino | A63B 69/224 |
| 11,707,661 | B1 * | 7/2023 | Magrino | A63B 21/0602 482/86 |
| 2002/0086776 | A1 * | 7/2002 | Fields | A63B 69/305 482/86 |
| 2002/0115538 | A1 * | 8/2002 | Wen | A63B 69/305 482/83 |
| 2014/0226919 | A1 * | 8/2014 | Fu | A63B 69/20 383/3 |
| 2015/0051053 | A1 * | 2/2015 | Conen | A63B 21/4035 482/108 |
| 2017/0036056 | A1 * | 2/2017 | Tomellini | A63B 21/072 |
| 2018/0050253 | A1 * | 2/2018 | Magrino | A63B 23/03575 |
| 2018/0333603 | A1 * | 11/2018 | Peyton | A63B 21/0605 |

* cited by examiner

*Primary Examiner* — Andrew S Lo
(74) *Attorney, Agent, or Firm* — Cooper Legal Group, LLC

(57) ABSTRACT

A weightlifting water bag is provided, including a bag body. The bag body includes an outer bag and an inner bag. The inner bag is provided inside the outer bag, an end of the inner bag is fixed to an inner wall of the outer bag, the inner bag divides an internal space of the outer bag to form an gas chamber and a water chamber, and an end face of the outer bag is provided with a water injection port and an inflation port, the water injection port is in communication with the water chamber, and the inflation port is in communication with the gas chamber.

9 Claims, 5 Drawing Sheets

A

WEIGHTLIFTING WATER BAG

CROSS-REFERENCE TO RELATED APPLICATION

The present application is based on and claims the priority benefits of China application No. 202420650641.0, filed on Mar. 30, 2024. The entirety of China application No. 202420650641.0 is hereby incorporated by reference herein and made a part of this specification.

TECHNICAL FIELD

The present application relates to a technical field of fitness equipment, and, more particularly, to a weightlifting water bag.

BACKGROUND ART

In order to facilitate users to carry weight-bearing devices and exercise anytime and anywhere, a weightlifting water bag appears on a market. A method for using the weightlifting water bag includes injecting an appropriate amount of water into the bag to give it a desired weight, and then injecting air into the bag to swell it. When there is relatively small weight as required, there will be redundant space inside the water bag for water to flow, which, however, causes continuous swilling of the water inside the water bag and constant change of a center of gravity of the water bag during weight-bearing training of a user, affecting the training of the user.

SUMMARY

In order to improve a using stability of a weightlifting water bag, the present application provides the weightlifting water bag.

The weightlifting water bag provided in the present application adopts the following technical solution:

the weightlifting water bag, comprising a bag body, wherein the bag body comprises an outer bag and an inner bag, the inner bag is provided inside the outer bag, ends of the inner bag are fixed to an inner wall of the outer bag, the inner bag divides an internal space of the outer bag to form an gas chamber and a water chamber, and an end face of the outer bag is provided with a water injection port and an inflation port, the water injection port is in communication with the water chamber, and the inflation port is in communication with the gas chamber.

By adopting the above technical solution, users can first inject an appropriate amount of water into the water chamber to obtain a required weight of a water bag. Then, injecting gas into the gas chamber through the inflation port to make the water bag bulge. Due to the ends of the inner bag being fixed to the inner wall of the outer bag, water is stably stored in the water chamber, reducing a shaking phenomenon caused by water flow. At the same time, a design of the gas chamber allows an entire water bag to maintain a stable shape, avoiding a problem of users training being affected by a constantly changing center of gravity of the water bag, and improving a using stability of the weightlifting water bag.

Optionally, the outer bag is fixed with two horizontal handles and two vertical handles, the two horizontal handles are spaced along a length direction of the outer bag, and the two vertical handles are spaced along a width direction of the outer bag.

By adopting the above technical solution, the horizontal handles and vertical handles are provided, and there is a certain distance between the two vertical handles and between the two horizontal handles to adapt to different training movements of the users.

Optionally, the outer bag is provided with a horizontal handle and two vertical handles, the horizontal handle is located in a middle of the outer bag, and the two vertical handles are respectively located on two sides of the horizontal handle.

By adopting the above technical solution, the horizontal handle is located in a middle of a product, the two vertical handles are respectively located at two ends of the horizontal handle, so that users can use them as kettlebells.

Optionally, further comprising two connecting plates, wherein the two connecting plates are respectively fixed with two ends of the outer bag and sealingly connected with the two ends of the outer bag, the two connecting plates are respectively fixed with two ends of the inner bag and sealingly connected with the two ends of the inner bag, and a telescopic rod is provided between the two connecting plates.

By adopting the above technical solution, when storing, the gas in the gas chamber and the water in the water chamber are discharged respectively, and the telescopic rod is controlled to contract, reducing an overall volume occupied by the weightlifting water bag and facilitating storage; when in use, controlling the telescopic rod to extend, so that the connecting plate drives the ends of the outer bag and the inner bag to move to two sides, and the outer bag and the inner bag can be unfolded, indirectly improving an efficiency of inflation and water injection, at the same time, the telescopic rod can also act as a handle for users to grip the weightlifting water bag for exercise.

Optionally, a sponge sleeve is sleeved outside the telescopic rod.

By adopting the above technical solution, an addition of the sponge sleeve provides users with a more comfortable gripping experience, effectively reducing a feeling of pressure on their hands, making it easier for users to grip the weightlifting water bag during long-term weight-bearing exercises. In addition, the sponge sleeve further includes an anti slip function, providing a stronger grip and preventing sliding caused by sweating on the hands or moisture on a surface of the weightlifting water bag.

Optionally, a sealing plate is slidably provided on each of the two connecting plates to cover the water injection port and the inflation port, and a driving assembly is provided on each of the two connecting plates for driving the sealing plate to slide.

By adopting the above technical solution, through a design by sliding on connecting plate, when the sealing plate slides for a certain distance, the sealing plate will cover one side of the water injection port and the inflation port, forming an effective seal. This seal design prevents dust, debris, or other external pollutants from entering the water injection port and the inflation port.

Optionally, the driving assembly comprises a screw rod and a guiding rod, the screw rod and the guiding rod are parallel to each other, the screw rod and the guiding rod are rotatably carried on the connecting plate, the screw rod is in thread fit with the sealing plate, and the guiding rod is movably passed through the sealing plate.

By adopting the above technical solution, when users rotate the screw rod through the driving assembly, a screw thread on the screw rod matches a corresponding screw thread on the sealing plate, causing the sealing plate to slide along an axis direction of the screw rod. At the same time, the guiding rod passes through the sealing plate to ensure that a movement trajectory of the sealing plate remains in a specified direction, preventing it from tilting or deviating from a track during a sliding process.

Optionally, each of the two connecting plates is further provided with a controlling assembly for controlling a rotation of the screw rod, the controlling assembly comprises an outer wheel ring, a transmission gear, and two bevel gears that are engaged with each other, the outer wheel ring and the transmission gear are rotatably carried on a surface of the connecting plate, an inner wall of the outer wheel ring is provided with gear teeth, the gear teeth are engaged with the transmission gear, a first bevel gear is coaxial with the transmission gear, and a second bevel gear is coaxial with the screw rod.

By adopting the above technical solution, when users operate the controlling assembly, the outer wheel ring and the transmission gear begin to rotate. Since the gear teeth of the outer wheel ring engage with the transmission gear, a rotation of the outer wheel ring will be transmitted to the transmission gear. Wherein, one of the bevel gears is coaxial with the transmission gear, while another bevel gear is coaxial with the screw rod. As the transmission gear rotates, the screw rod which is coaxial with the bevel gear begins to rotate through a transmission effect of the bevel gear.

Optionally, a sidewall of the outer wheel ring is provided with a gripping portion.

By adopting the above technical solution, users can rotate the outer wheel ring more stably by gripping the gripping portion, which helps users control the controlling assembly more easily and achieve precise rotation of the screw rod.

Optionally, a surface of each of the two connecting plates is provided with a fixing assembly, the fixing assembly comprises an installation seat, an insertion rod, and a resetting spring, the installation seat is installed on the surface of the connecting plate, and the insertion rod is slidably provided on the installation seat, a slot is defined in a sidewall of the gripping portion, the gripping portion is configured to rotate to make the insertion rod in insertion fit with the slot, a first end of the resetting spring is fixed with the installation seat, and a second end of the resetting spring is fixed with the insertion rod.

By adopting the above technical solution, users rotates the gripping portion by a certain angle, and the gripping portion abuts against an end of the insertion rod, the resetting spring is compressed, when the gripping portion rotates to a position corresponding to the insertion rod and the slot, under an elastic force of the resetting spring, it triggers an insertion of the insertion rod and the gripping portion, completing a locking of the fixing assembly.

In summary, the present application includes at least one of the following beneficial technical effects:

1. users can first inject the appropriate amount of water into the water chamber to obtain the required weight of the water bag. Then, injecting gas into the gas chamber through the inflation port to make the water bag bulge. Due to the end of the inner bag being fixed to the inner wall of the outer bag, water is stably stored in the water chamber, reducing the shaking phenomenon caused by water flow. At the same time, the design of the gas chamber allows the entire water bag to maintain the stable shape, avoiding the problem of users training being affected by the constantly changing center of gravity of the water bag, and improving the using stability of the weightlifting water bag;
2. the horizontal handles and vertical handles are provided, and there is a certain distance between the two vertical handles and between the two horizontal handles to adapt to different training movements of the users;
3. when storing, the gas in the gas chamber and the water in the water chamber are discharged respectively, and the telescopic rod is controlled to contract, reducing the overall volume occupied by the weightlifting water bag and facilitating storage; when in use, controlling the telescopic rod to extend, so that the connecting plate drives the ends of the outer bag and the inner bag to move to two sides, and the outer bag and the inner bag can be unfolded, indirectly improving the efficiency of inflation and water injection, at the same time, the telescopic rod can also act as the handle for users to grip the weightlifting water bag for exercise.

DETAILED DESCRIPTION

Figure 1:
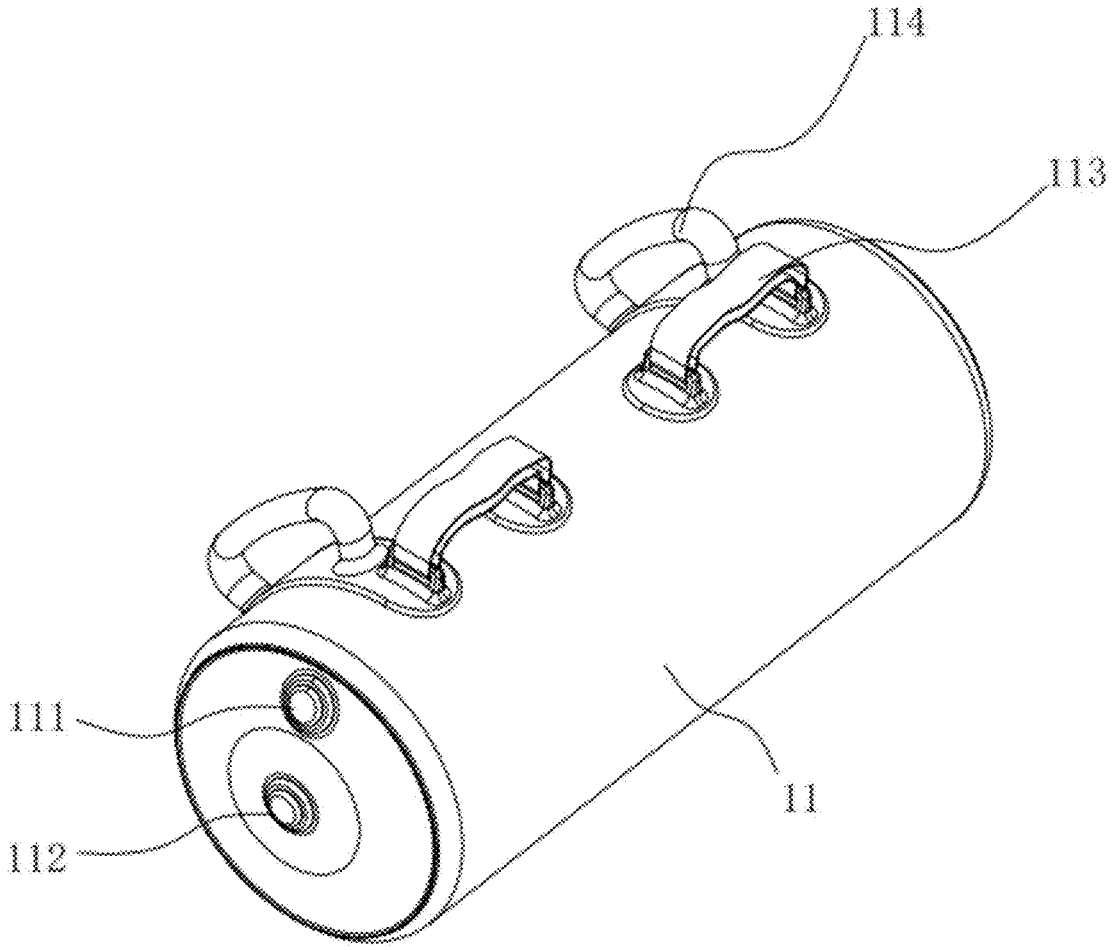
FIG. 1 is an overall schematic structure view of a weightlifting water bag according to Embodiment 1 of the present application.
Figure 2:
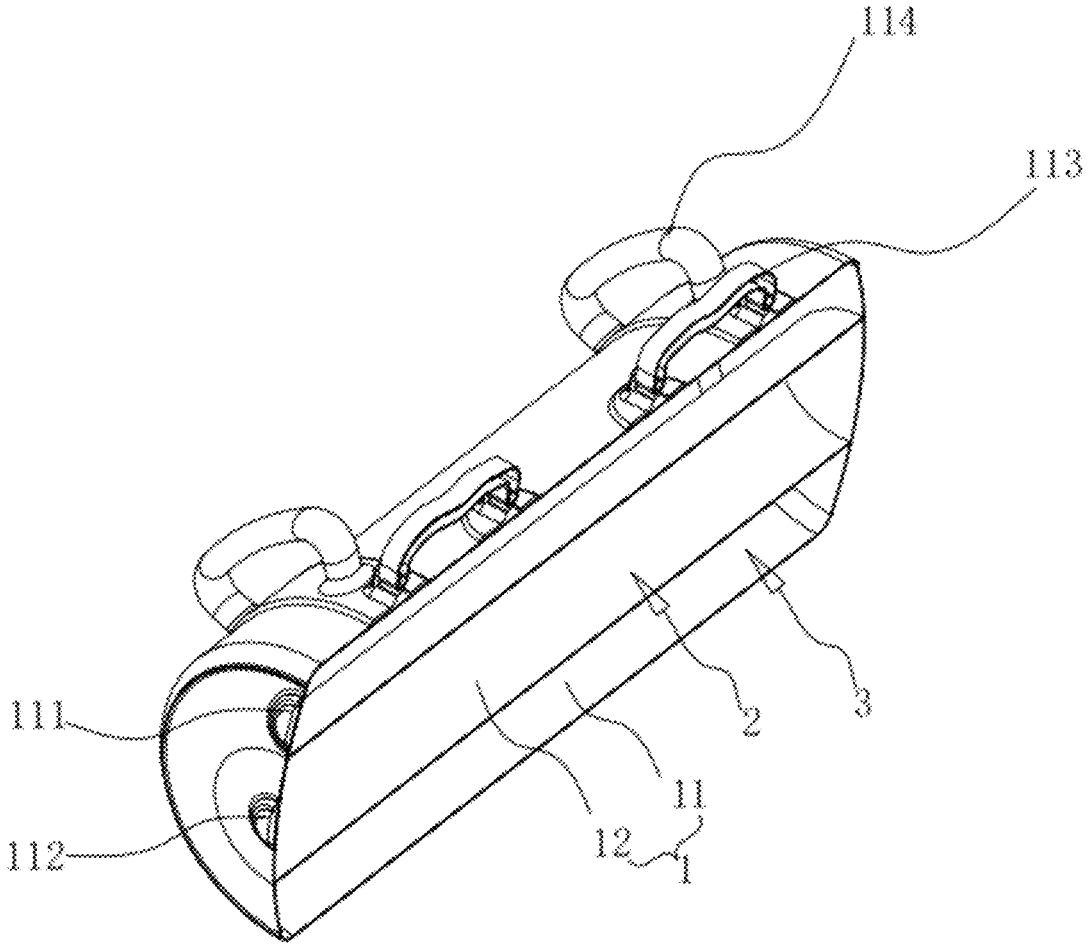
FIG. 2 is a partially schematic cross-sectional view of the weightlifting water bag according to Embodiment 1 of the present application.

The present application will be further described in detail below with reference to FIGS. 1-2.

Embodiment 1

This embodiment of the present application discloses a weightlifting water bag. Referring to FIGS. 1 and 2, the weightlifting water bag includes a bag body 1, which includes an outer bag 11 and an inner bag 12. The outer bag 11 is hollow and the inner bag 12 is provided inside the outer bag 11, an end of the inner bag 12 is fixed to an inner wall of the outer bag 11, and the inner bag 12 divides an internal space of the outer bag 11 to form a gas chamber 2 and a water chamber 3. When the gas chamber 2 is filled with gas and the water chamber 3 is filled with water, the outer bag 11 assumes a cylindrical shape.

Further, an end face of the outer bag 11 is provided with a water injection port 111 and an inflation port 112. The water injection port 111 is in communication with the water chamber 3, the inflation port 112 is in communication with the gas chamber 2. In the embodiment, both of the water injection port 111 and the inflation port 112 are provided with a one-way valve port, that is, gas and water can only flow in one direction. The specific description is as follows.

Specifically, the one-way valve port in the embodiment of the present application is such a design that allows fluid (gas or liquid) to flow freely in one direction while preventing fluid from flowing in another direction. In a design of the water injection port 111 and inflation port 112, providing the one-way valve port ensures the following two points:

firstly, sealing in natural state: when a system is in natural state, that is, when a user performs no operation, the one-way valve port prevents air and water in the gas chamber 2 and water chamber 3 from leaking out of the water injection port 111 and the inflation port 112. This ensures that the weightlifting water bag remains sealed when no water injection or inflation operations is needed, preventing unnecessary liquid or gas leakage.

secondly, ventilation and drainage during user operation: when an user intends to perform water injection or inflation operations, the user manually injects air and water into the gas chamber 2 and water chamber 3 or discharges them from the gas chamber 2 and water chamber 3 through respective pumps via the water injection port 111 and inflation port 112, in conjunction with corresponding manual operations. During this process, manual operation of the user results in opening of the one-way valve port, allowing fluid to flow in a specific direction. Once water injection or inflation is completed and the users stop operating, the one-way valve port will automatically close to maintain a sealing of the system and prevent leakage during normal use. Therefore, this design not only ensures a safety of the system and prevents accidental leakage, but also provides an user-friendly operating experience, allowing the user to easily perform water injection and inflation operations.

In summary, the user can first inject an appropriate amount of water into the water chamber 3 to obtain a required weight of a water bag. Then, injecting gas into the gas chamber 2 through the inflation port 112 to swell the water bag. Due to the end of the inner bag 12 being fixed to the inner wall of the outer bag 11, water is stably stored in the water chamber 3, reducing swilling caused by water flow. Meanwhile, providing of the gas chamber 2 allows an entire water bag to maintain a stable shape, avoiding a problem of problematic user training due to a constantly changing center of gravity of the water bag, and improving using stability of the weightlifting water bag.

Further, the outer bag 11 is fixed with two horizontal handles 113 and two vertical handles 114, the two horizontal handles 113 are spaced along a length direction of the outer bag 11, and the two vertical handles 114 are spaced along a width direction of the outer bag 11.

In this way, providing the horizontal handles 113 and vertical handles 114 spaced by a certain distance between the two vertical handles 114 and between the two horizontal handles 113 can help the user to adapt to different training actions.

An implementation principle of the weightlifting water bag in the embodiment of the present application is as follows.

The user can first inject the appropriate amount of water into the water chamber 3 to obtain the required weight of the water bag. Then, gas is injected into the gas chamber 2 through the inflation port 112 to swell the water bag. Due to the end of the inner bag 12 being fixed to the inner wall of the outer bag 11, water is stably stored in the water chamber 3, reducing the swilling caused by water flow. Meanwhile, the design of the gas chamber 2 allows the entire water bag to maintain the stable shape, avoiding the problem of problematic user training due to constantly changing center of gravity of the water bag, and improving the using stability of the weightlifting water bag.

Embodiment 2

Figure 3:
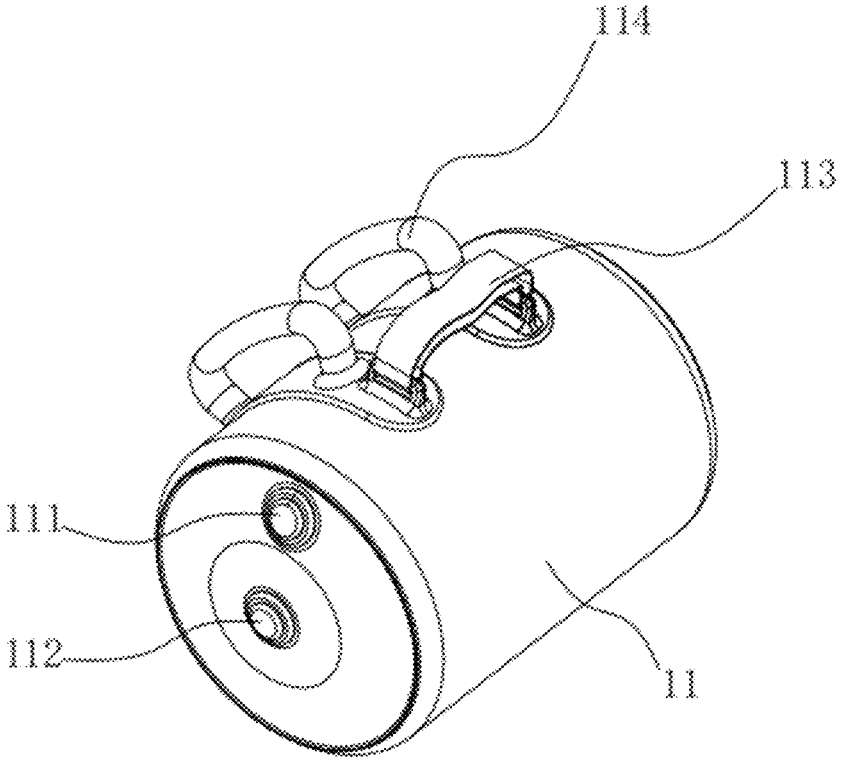
FIG. 3 is an overall schematic structure view of a weightlifting water bag according to Embodiment 2 of the present application.

Referring to FIG. 3, a difference from embodiment 1 is that, a length of the outer bag 11 and inner bag 12 in this embodiment of the present application is smaller than that of the outer bag 11 and inner bag 12 in Embodiment 1, the outer bag 11 is provided with a horizontal handle 113 and two vertical handles 114, the horizontal handle 113 is located in a middle of the outer bag 11, and the two vertical handles 114 are respectively located on both sides of the horizontal handle 113.

Therefore, the horizontal handle 113 is located in a middle of the water bag, the two vertical handles 114 are respectively located at two ends of the horizontal handle 113, so that users can use them as kettlebells.

Embodiment 3

Figure 4:
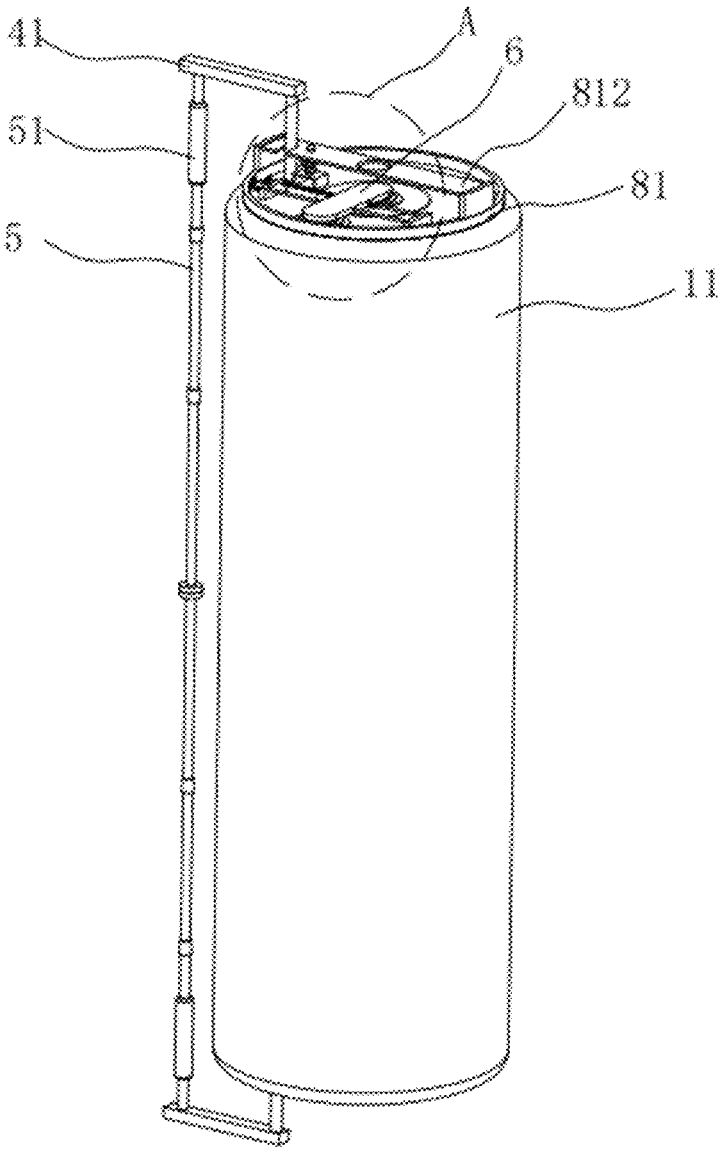
FIG. 4 is an overall schematic structure view of a weightlifting water bag according to Embodiment 3 of the present application.
Figure 5:
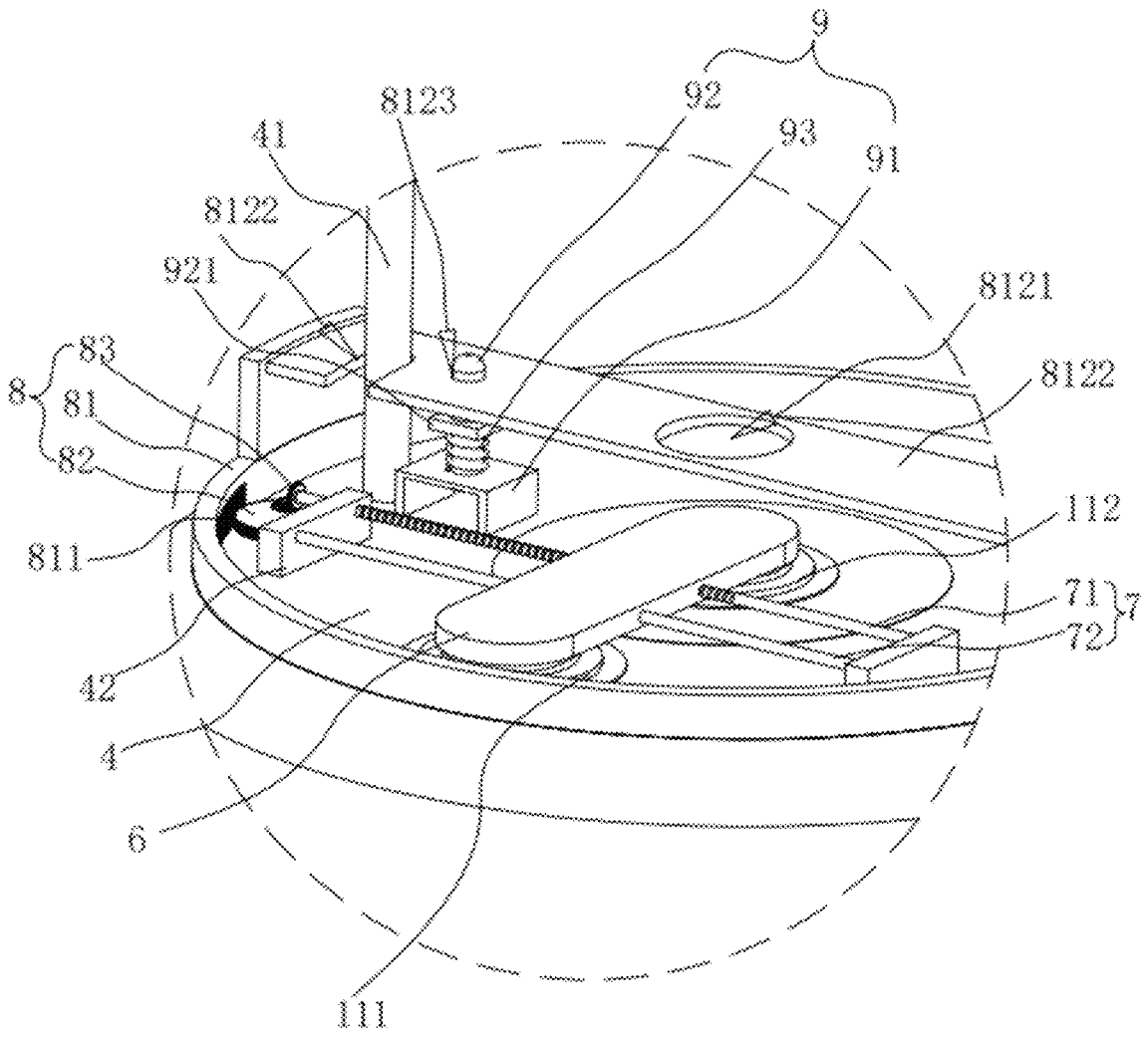
FIG. 5 is an enlarged schematic view of Portion A in FIG. 4.

Referring to FIGS. 4 and 5, a difference from Embodiment 1 is that, it further includes two connecting plates 4, which assumes a circular shape, the two connecting plates 4 are respectively fixed and sealed with two ends of the outer bag 11, the two connecting plates 4 are respectively fixed and sealed with two ends of the inner bag 12, and a telescopic rod 5 is provided between the two connecting plates 4.

Correspondingly, for storage, the gas in the gas chamber 2 and the water in the water chamber 3 are discharged respectively, and the telescopic rod 5 is controlled to contract, reducing an overall volume occupied by the weightlifting water bag and facilitating storage. For use, the telescopic rod 5 is stretched, so that the connecting plate 4 drives the ends of the outer bag 11 and the inner bag 12 to move toward both sides to unfold the outer bag 11 and the inner bag 12, indirectly improving an efficiency of inflation and water injection. Meanwhile, the telescopic rod 5 can also act as a handle for users to grip the weightlifting water bag for exercise.

In the embodiment, there are two telescopic rods 5, sidewalls of the two connecting plates 4 are fixed with connecting rods 41, cross-sections of the connecting rods 41 assumes an L-shape, and ends of two connecting rods 41 are respectively vertically fixed to the sidewalls of the two connecting plates 4. Meanwhile, an end of one telescopic rod 5 is vertically fixed to the other end of one connecting rod 41, and an end of the other telescopic rod 5 is vertically fixed to a sidewall of the other connecting rod 41, and other ends of the two telescopic rods 5 are fixed with each other.

Furthermore, an outside of the telescopic rod 5 is sleeved with a sponge sleeve 51, which is located on a side of the telescopic rod 5 facing the connecting rod 41. Providing the sponge sleeve 51 endows the user with a more comfortable gripping experience, effectively reducing a feeling of pressure on their hands, making it easier for users to grip the weightlifting water bag during long-term weight-bearing exercises. In addition, the sponge sleeve 51 further serves anti-slip function, providing a stronger grip and preventing sliding caused by sweating on the hands or moisture on a surface of the water bag.

In another aspect, each of the two connecting plates 4 is slidably provided with a sealing plate 6, which is parallel to the connecting plate 4. After sliding for a certain distance, the sealing plate 6 is covered on the water injection port 111 and the inflation port 112, a driving assembly 7 is provided on each of the two connecting plates 4 to drive a sliding of the sealing plate 6.

Correspondingly, due to a design of sliding on the connecting plate 4, when the sealing plate 6 slides for a certain distance, the sealing plate 6 will cover one side of the water injection port 111 and the inflation port 112, forming an effective seal. This seal design prevents dust, debris, or other external pollutants from entering the water injection port 111 and the inflation port 112.

Specifically, the driving assembly 7 includes a screw rod 71 and a guiding rod 72, which are parallel to each other. A surface of the connecting plate 4 is fixed with two bearing seats 42, which are parallel to each other, an end of the screw rod 71 and an end of the guiding rod 72 are both rotatably carried on one of the bearing seats 42, while the other end of the screw rod 71 and the other end of the guiding rod 72 are rotatably carried on another bearing seat 42. The screw rod 71 is in thread fit with the sealing plate 6, and the guiding rod 72 movably passes through the sealing plate 6.

Therefore, when users rotate the screw rod 71 through the driving assembly 7, a screw thread on the screw rod 71 matches a corresponding screw thread on the sealing plate 6, causing the sealing plate 6 to slide along an axis direction of the screw rod 71. At the same time, the guiding rod 72 passes through the sealing plate 6 to ensure that a movement trajectory of the sealing plate 6 is kept in a specified direction, preventing it from tilting or deviating from a track during sliding.

Furthermore, for convenient user operation, each of the two connecting plates 4 is further provided with a controlling assembly 8 for controlling a rotation of the screw rod 71. The controlling assembly 8 includes an outer wheel ring 81, a transmission gear 82, and two bevel gears 83 which are engaged with each other. The outer wheel ring 81 assumes circular shape, an outer diameter of the outer wheel ring 81 is same as an outer diameter of the connecting plate 4, and both the outer wheel ring 81 and the transmission gear 82 are rotatably carried on a surface of the connecting plate 4, wherein, an axis of the transmission gear 82 and the outer wheel ring 81 are parallel to an axis of the connecting plate 4. In addition, an inner wall of the outer wheel ring 81 is provided with gear teeth 811, the gear teeth are engaged with the transmission gear 82, one of the bevel gears 83 is coaxial with the transmission gear 82, and the other bevel gear 83 is coaxial with the screw rod 71.

Therefore, when a user operates the controlling assembly 8, the outer wheel ring 81 and the transmission gear 82 begin to rotate. Since the gear teeth 811 of the outer wheel ring 81 are engaged with the transmission gear 82, a rotation of the outer wheel ring 81 will be transmitted to the transmission gear 82. One of the bevel gears 83 is coaxial with the transmission gear 82, while another bevel gear 83 is coaxial with the screw rod 71. As the transmission gear 82 rotates, the screw rod 71 which is coaxial with the bevel gear 83 begins to rotate through a transmission effect of the bevel gear 83.

Further, a sidewall of the outer wheel ring 81 departing from the connecting plate 4 is vertically fixed with a gripping portion 812. The gripping portion 812 has a U-shaped cross-section, so that a user can rotate the outer wheel ring 81 more stably by gripping the gripping portion 812, which helps the user to control the controlling assembly 8 more easily and achieve precise rotation of the screw rod 71.

In addition, a sidewall of the gripping portion 812 is further provided with a first positioning notch 8121 and a second positioning notch 8122. A position of the first positioning notch 8121 corresponds to a position of the inflation port 112, and a position of the second positioning notch 8122 corresponds to a position of the connecting rod 41. The first positioning notch 8121 can reduce an obstruction of the gripping portion 812 on the inflation port 112, allowing the user to use the inflation port 112 normally through the first positioning notch 8121. At the same time, after the gripping portion 812 is rotated by a certain angle, the connecting rod 41 is accommodated in the second positioning notch 8122. The second positioning notch 8122 can reduce an occurrence of physical interference between the connecting rod 41 and the gripping portion 812, and improve overall stability.

In another aspect, each of the two connecting plates 4 is provided with a fixing assembly 9 on the surface. The fixing assembly 9 includes an installation seat 91, an insertion rod 92, and a resetting spring 93, the installation seat 91 is vertically fixed to the surface of the connecting plate 4, and the insertion rod 92 is slidably provided on the installation seat 91 along an axis direction of the connecting plate 4. In addition, a slot 8123 is defined on the sidewall of the gripping portion 812, and the gripping portion 812 is rotated by a certain angle to make the insertion rod 92 fit with the slot 8123. In addition, an outer wall of the insertion rod 92 is fixed with a connecting block 921, an end of the resetting spring 93 is fixed with the installation seat 91, and the other end of the resetting spring 93 is fixed with the connecting block 921.

Therefore, the user rotates the gripping portion 812 by a certain angle, so that the gripping portion 812 abuts against an end of the insertion rod 92, and the resetting spring 93 is compressed. When the gripping portion 812 is rotated to a position corresponding to the insertion rod 92 and the slot 8123, under an elastic force of the resetting spring 93, it triggers an insertion of the insertion rod 92 and the gripping portion 812, completing a locking of the fixing assembly 9.

Similarly, when unlocking is required, the user presses the insertion rod 92 to make it pass through the slot 8123 and be positioned below the gripping portion 812, by which the resetting spring 93 is compressed. The user synchronously rotates the gripping portion 812 to separate the gripping portion 812 from the insertion rod 92, and, under the elastic force of the resetting spring 93, a reset of the insertion rod 92 is achieved.

The above are the preferred embodiments of the present application, which are not intended to limit the protection scope of the present application. Therefore, all equivalent changes made according to the structure, shape and principle of the present application should be covered within the protection scope of the present application.

LISTING OF REFERENCE SIGNS

1. Bag Body
11. Outer Bag
111. Injection Port
112. Inflation Port
113. Horizontal Handle
114. Vertical Handle
12. Inner Bag
2. Gas Chamber
3. Water Chamber
4. Connecting Plate
41. Connecting Rod
42. Bearing Seat
5. Telescopic Rod
51. Sponge Sleeve
6. Sealing Plate
7. Driving Assembly
71. Screw Rod
72. Guiding Rod
8. Controlling Assembly
81. Outer Wheel Ring
811. Gear Teeth

812. Gripping Portion
8121. First Positioning Notch
8122. Second Positioning Notch
8123. Slot
82. Transmission Gear
83. Bevel Gear
9. Fixing Assembly
91. Installation Seat
92. Insertion Rod
921. Connecting Block
93. Resetting Spring

What is claimed is:

1. A weightlifting water bag, comprising a bag body and two connecting plates, wherein the bag body comprises an outer bag and an inner bag, the inner bag is provided inside the outer bag, two ends of the inner bag are fixed to an inner wall of the outer bag, the inner bag divides an internal space of the outer bag to form a gas chamber and a water chamber, an end face of the outer bag is provided with a water injection port and an inflation port, the water injection port is in communication with the water chamber, the inflation port is in communication with the gas chamber, the two connecting plates are respectively fixed with two ends of the outer bag and sealingly connected with the two ends of the outer bag, the two connecting plates are respectively fixed with the two ends of the inner bag and sealingly connected with the two ends of the inner bag, and a telescopic rod is provided between the two connecting plates.

2. The weightlifting water bag according to claim 1, wherein the outer bag is fixed with two horizontal handles and two vertical handles, the two horizontal handles are spaced along a length direction of the outer bag, and the two vertical handles are spaced along a width direction of the outer bag.

3. The weightlifting water bag according to claim 1, wherein the outer bag is provided with a horizontal handle and two vertical handles, the horizontal handle is located in a middle of the outer bag, and the two vertical handles are respectively located on both sides of the horizontal handle.

4. The weightlifting water bag according to claim 1, wherein a sponge sleeve is sleeved outside the telescopic rod.

5. The weightlifting water bag according to claim 1, wherein a sealing plate is slidably provided on each of the two connecting plates to cover the water injection port and the inflation port, and a driving assembly is provided on each of the two connecting plates for driving the sealing plate to slide.

6. The weightlifting water bag according to claim 5, wherein the driving assembly comprises a screw rod and a guiding rod, the screw rod and the guiding rod are parallel to each other, the screw rod and the guiding rod are rotatably carried on the two connecting plates, the screw rod is in thread fit with the sealing plate, and the guiding rod is movably passed through the sealing plate.

7. The weightlifting water bag according to claim 6, wherein each of the two connecting plates is further provided with a controlling assembly for controlling a rotation of the screw rod, the controlling assembly comprises an outer wheel ring, a transmission gear, and two bevel gears that are engaged with each other, the outer wheel ring and the transmission gear are rotatably carried on a surface of a corresponding one of the two connecting plates, an inner wall of the outer wheel ring is provided with gear teeth, the gear teeth are engaged with the transmission gear, a first bevel gear is coaxial with the transmission gear, and a second bevel gear is coaxial with the screw rod.

8. The weightlifting water bag according to claim 7, wherein a sidewall of the outer wheel ring is provided with a gripping portion.

9. The weightlifting water bag according to claim 8, wherein a surface of each of the two connecting plates is provided with a fixing assembly, the fixing assembly comprises an installation seat, an insertion rod, and a resetting spring, the installation seat is installed on the surface of the corresponding one of the two connecting plates, the insertion rod is slidably provided on the installation seat, a slot is defined in a sidewall of the gripping portion, the gripping portion is configured to rotate to cause the insertion rod to be in insertion fit with the slot, a first end of the resetting spring is fixed with the installation seat, and a second end of the resetting spring is fixed with the insertion rod.

* * * * *